US005165246A

United States Patent [19]

Cipolla et al.

[11] Patent Number: 5,165,246

[45] Date of Patent: Nov. 24, 1992

[54] TRANSPORT TRAILER FOR ULTRA-HIGH-PURITY CRYOGENIC LIQUIDS

[75] Inventors: Richard C. Cipolla, Williamsville; Jeffrey R. Huber, Grand Island; Victor E. Bergsten, East Amherst, all of N.Y.

[73] Assignee: Praxair Technology Inc., Danbury, Conn.

[21] Appl. No.: 793,006

[22] Filed: Nov. 15, 1991

[51] Int. Cl.[5] ..... F17C 9/00

[52] U.S. Cl. ..... 62/47.1; 62/50.2; 137/210

[58] Field of Search ..... 62/47.1, 50.2, 45.1; 137/210, 563

[56] References Cited

U.S. PATENT DOCUMENTS

| | | | |
|---|---|---|---|
| 2,500,249 | 3/1950 | Hansen | 137/210 X |
| 2,576,958 | 12/1951 | Wildhack | 137/210 X |
| 2,580,710 | 1/1952 | Wildhack | 62/1 |
| 2,657,542 | 11/1953 | Wildhack | 137/210 X |
| 3,122,000 | 2/1964 | Sirocky | 62/55 |
| 3,197,972 | 8/1965 | King | 62/55 |
| 3,240,377 | 3/1966 | Dixon | 220/14 |
| 3,577,739 | 5/1971 | Botkin | 137/210 X |
| 3,602,003 | 8/1971 | Hampton | 62/54 |
| 3,710,584 | 1/1973 | Leonard | 62/54 |
| 4,475,348 | 10/1984 | Remes | 62/55 |
| 4,598,554 | 7/1986 | Bastian | 62/50.2 |

OTHER PUBLICATIONS

"Characterization of Surface Treated 316L Stainless Steel Tubings to Prevent Contamination in Gas Distribution Systems", A. Kumar & Cecil E. Dyer, Solid State Technology, Feb., 1987, pp. 89, 91, 93.

"Ultrahigh Purity Gas Distribution Systems", J. Hackenberg, M. Spencer, J. Va. Sci. Technol. A7(3), May/-Jun. 1989, 1989 American Vacuum Society, pp. 2504–2507.

Bulk Transporter, Jan. 1991, p. 17.

*Primary Examiner*—Alan Cohan

*Attorney, Agent, or Firm*—Peter Kent

[57] ABSTRACT

A trailer with piping and accessories capable of maintaining the ultra high purity of a cryogenic liquid while receiving and transporting the liquid, purging an external receiver, and transferring liquid to the receiver. The trailer has a heat exchnger for vaporizing a liquid flow from its liquid container into warmed gas. The gas is used for purging an external receiver and for pressurizing the liquid container sufficiently to transfer liquid into the purged receiver. The trailer piping allows purging of and then transferring to the receiver without opening any connections. The number of welded surfaces in the trailer capable of trapping and generating contaminants are reduced, particularly the number of welded penetrations of the liquid container.

22 Claims, 2 Drawing Sheets

TRANSPORT TRAILER FOR ULTRA-HIGH-PURITY CRYOGENIC LIQUIDS

FIELD OF THE INVENTION

This invention pertains to a trailer for transporting and delivering ultra-high-purity cryogenic liquids.

BACKGROUND OF THE INVENTION

Industrial gases have achieved widespread utility in industry, and are often supplied to users as cryogenic liquids which are vaporized into the gaseous state for use. The most prevalently used gases are oxygen, nitrogen, argon and hydrogen. Commonly, the gases supplied are of industrial grade with not more than 5000 parts per million of impurities or contaminants. However, the gases required for use in some new semiconductor manufacturing processes must have very low levels of trace contaminants. Increasingly such low levels are required to be under 1 part per million in concentration. Oxygen, for example, now is often required with a purity of 99.9999% by volume. Thus the cryogenic liquids distributed to bulk users can be classified as either of industrial purity or ultra high purity. The ability to consistently deliver an ultra-high-purity cryogenic liquid requires the use of transport trailers and delivery procedures considerably different from those used in the past for industrial purity cryogenic liquids.

A conventional trailer for transporting industrial grade cryogenic liquids has an inner container enclosed in an outer casing. The inner container is generally constructed from type 304 stainless steel or aluminum, typically for a working pressure of 30 psig. Three lateral anti-slosh baffles divide the inner vessel in about four equal volumes. The annular space between the inner container and the outer casing usually contains perlite or fiberglass batting, and is evacuated to develop improved insulating properties. The use points for industrial grade cryogenic liquids are generally located close to the producing plant, so that the thermal insulation achieved with evacuated perlite or fiberglass is adequate to achieve acceptable vaporization losses.

Conventional trailers are equipped with an onboard pump for delivering liquid from the inner container to an external receiver or tank at a use site. The trailer piping is type 304 stainless steel. Valves, gauges, instruments and controls, however, are not necessarily constructed from stainless steel. Bronze, copper and aluminum alloys are utilized. Such components are joined to the piping by threaded or flanged connections.

Conventional trailers have a heat exchanger solely for pressure building in the inner container, typically to a maximum working pressure of 30 psig. The pressure building heat exchanger is heated by natural convection from the atmosphere. The coil is normally constructed of extruded aluminum tubing which is flanged to the stainless steel inlet and outlet piping.

Conventional trailers have a heat exchanger line which leads from a lower port in the inner container to the heat exchanger. A control valve is positioned in this line. At the heat exchanger outlet, a check valve is positioned to prevent back flow into the heat exchanger and into the inner container.

A pressure building line leads from the outlet of the heat exchanger and makes a penetration of the inner container at a level near the top of the container. As used herein, penetration shall mean an opening in the inner container through which a conduit enters and protrudes, or at which a conduit terminates forming an opening to the conduit. The pressure building line terminates in the vapor space within the inner container at a level which is above the liquid level when the inner container is filled to its intended level. Through this line, the vapor or gas which is produced from the liquid vaporized in the heat exchanger is conveyed to the top of the inner container where it serves to build the pressure within the inner container. A check valve, but no control or shut off valve is provided in this line. As used herein, gas shall have the same meaning as vapors.

Branching from the pressure building line is a gas withdrawal line which leads successively to a valve and a first terminal. This terminal has several uses. It is used to connect to a line leading to a recovery unit in an air liquifaction plant to recover vapor generated from the liquid in the inner container. This terminal is also used to connect to a line leading to a ground-mounted pump to recover vapor during cool down of the pump with cryogenic liquid from the trailer. This terminal is also used to connect to a supplementary heat exchanger especially supplied as required for warming cold gas from the inner container and from the heat exchanger. The warmed gas is conveyed to a receiver for purging as described later.

From a second port proximate the bottom of the inner container, a liquid fill line with a control valve runs to a second terminal for connection to an external source of supply of cryogenic liquid. Branching from the lower liquid fill line, from a point between the control valve and the second terminal, is an upper fill line that has a control valve and leads to the top of the inner container. This line penetrates the inner container and runs substantially the full length of the inner container within and along the top of the container. Within the inner container, this line has perforations to distribute liquid or vapor transferred into the inner container uniformly along the length of the container. Liquid is usually transferred and distributed into the trailer through this line to prevent temperature gradients from occurring along the length of the inner container.

Branching from the lower liquid fill line, from a point between the inner container and the control valve, is a liquid delivery line. The liquid delivery line contains successively a control valve, a pump, a check valve and terminates in a third terminal. This delivery line is used to deliver and meter liquid to a customer s receiver.

From the liquid delivery line, from a point between the pump and the check valve, a vapor return line with a control valve runs into the pressure building line. This valve is opened and the vapor return line is used when the pump and the liquid delivery line are warm and are initially placed into service. The vapor return line returns vapor created from liquid vaporized in the warm pump and liquid delivery line to the top of the inner container.

An excess pressure relief line penetrates the inner container at an upper level, and within the inner container terminates at a level which is above the liquid level at the intended full capacity of the trailer. Externally this line leads to rupture disks and spring loaded pressure relief valves.

A tube enters the inner container through a penetration to sense the pressure proximate the top of the inner container. Similarly, another tube enters the inner container through a penetration to sense the pressure proximate the bottom of the inner container. A differential pressure indicator connects across these lines. A pressure gauge is also connected to the line sensing the pressure proximate the top of the inner container.

Typically two lines for liquid level sensing also penetrate the top of the inner container and extend a short distance downward. These lines terminate at different levels within the inner container. Opening the trycock on either of these lines and observing the phase of the fluid which issues determines whether the liquid level is above or below the end of the trycock line. One of these liquid level sensing lines is selected and used to fill the trailer inner container with liquid to the level indicated by that line.

In placing a trailer into service for the first time, or after its wetted volumes and surfaces have been exposed to air and atmospheric moisture, or when the cryogenic liquid to be carried is different from that carried before, it is necessary to purge these prior contents from the wetted volumes and surfaces. Otherwise the prior contents will contaminate the new contents. As used herein, wetted surface shall mean surfaces wetted by, that is, coming in contact with liquid or vapor contents of the trailer during the performance of its functions. By prior contents is meant atmospheric air and moisture which enter an empty trailer, as well as prior cryogenic liquid contents which are different from new contents. Purging is accomplished by flowing through the wetted volumes some of the intended new contents at a temperature greater than 32° F. A purge gas temperature greater than 32° F. is necessary to prevent moisture from freezing out on the wetted surfaces.

Where the intended new contents are of industrial grade purity, the wetted volumes and surfaces in conventional trailers are readily purged to a level where they will not contaminate the new contents. However, if the intended new contents are of ultra high purity, purging of a conventional trailer requires an unduly large expenditure of new contents and an unduly long time.

Welded areas in general have a high degree of surface roughness, porosity and crevices which adsorb, trap and retain prior contents. The wetted surfaces in conventional trailers have a large number of welded areas which are detrimental to maintaining ultra-high-purity contents. In particular, the welds around penetrations of the inner container for ports and entering lines are susceptible to a high degree of surface roughness, porosity and crevice formation. In a conventional trailer, the inner container has nine or more penetrations.

The wetted surfaces in conventional trailers also typically have a roughness conducive to spalling of minute particles which become contaminants. In addition, joints and valve stems are sealed by elastomers which exude contaminants. Thus conventional trailers have shortcomings which preclude their use for transporting ultra-high-purity cryogenic liquids.

Prior to filling an empty external receiver from a cryogenic liquid trailer, it is necessary to purge the receiver to remove the prior contents both from the interior volume of the receiver and from its surfaces. In particular it is desirable to purge out substances that would freeze out on the interior surfaces of the receiver when cryogenic liquid is introduced. Warm purge gas is obtained by warming vapor generated from the cryogenic liquid in the trailer.

To supply warm gas from a conventional trailer for purging a receiver, a supplementary heat exchanger is connected to the first terminal that is, to the terminal at the end of the line branching from the line leading to the vapor space in the inner container. Cold vapor is drawn from the inner container and warmed in the supplementary heat exchanger to at least 32° F. and directed to the external receiver. The supplementary heat exchanger is usually heated by natural convection from the atmosphere. An external heat source is applied to the supplementary heat exchanger if ambient conditions below 32° F. are encountered.

As vapor is removed from the vapor space in the inner container and conveyed to the external receiver for purging, the pressure in the inner container decreases. In order to maintain the pressure within the inner container, liquid is allowed to enter from the bottom of the inner container into the pressure building heat exchanger which is permanently mounted on the trailer. The liquid entering the pressure building heat exchanger is vaporized and conveyed to the top of the inner container. Some of this vapor may flow directly into the supplementary heat exchanger, be warmed and be used as purge gas.

The method of purging an external receiver from a conventional trailer with industrial grade cryogenic liquid has a number of disadvantages. First, a supplementary heat exchanger must be transported to the site of the external receiver. The supplementary heat exchanger itself is normally full of contaminated gas and itself requires purging. Upon the completion of purging of the external receiver, the receiver is disconnected from supplementary heat exchanger and reconnected to the third terminal that is, to the terminal at the end of the liquid delivery line. During this operation, air enters and contaminates the connections. While this is not of great significance in delivering industrial grade cryogenic liquids, this procedure noticeably contaminates an ultra-high-purity liquid. Hence the piping layout, the multiple terminals for external connections and the procedures employed with conventional cryogenic liquid trailer are unsuitable to maintain and deliver an ultra-high-purity cryogenic liquid.

It is an object of this invention to provide a trailer for transporting ultra-high-purity cryogenic liquid and maintaining the purity of the contents.

It is also an object of this invention to provide a trailer for transporting ultra-high-purity cryogenic liquid with the capability of purging an external receiver and transferring the contents of the trailer to the receiver without appreciable contamination of the contents.

It is another object of this invention to provide a trailer which can be rapidly and efficiently purged of prior contents which may contaminate the new contents of the trailer.

It is a feature of this invention that the amount of surface area wetted by the trailer contents is reduced over that of conventional trailers.

It is another feature of this invention that the welded surface area wetted by the trailer contents is reduced over that of conventional trailers.

It is another feature of this invention that the wetted surface areas in the trailer have low roughness.

It is another feature of this invention that the inner container of the trailer has fewer penetrations for ports and lines than inner containers in conventional trailers.

It is another feature of this invention that the connection from the trailer to an external receiver is maintained and not opened when switching from purging of the receiver to filling of the receiver with liquid contents from the trailer.

It is an advantage of this invention that no supplementary external equipment is used to purge an external receiver.

It is another advantage that no atmospheric air or other contaminant is introduced into the contents in changing from purging to filling of an external receiver.

SUMMARY OF THE INVENTION

This invention provides a trailer for transporting cryogenic liquid, purging a receiver and transferring liquid into the receiver. A Preferred embodiment of the trailer comprises:

(a) an inner container for liquid and gas;
(b) a heat exchanger for gasifying cryogenic liquid;
(c) a heat exchanger feed conduit communicating the inlet of the heat exchanger with a first lower port proximate the bottom in said inner container;
(d) a terminal for connection to an external source of cryogenic liquid or to a receiver;
(e) a purge gas supply conduit connecting the outlet of the heat exchanger with the terminal, the purge gas supply conduit for supplying gas through the terminal to purge a receiver connected to the terminal;
(f) a purge gas control valve in the purge gas supply conduit;
(g) a pressure building conduit connecting the outlet of the heat exchanger with an upper port proximate the top in the inner container, for supplying gas from the heat exchanger to the inner container to build pressure in the inner container;
(h) a valve in the pressure building conduit for controlling the flow of gas into, and the pressure buildup in, the inner container.
(i) a lower transfer conduit communicating the terminal with a second lower port proximate the bottom in the inner container, for transferring liquid to and from the inner container via the terminal;
(j) a lower transfer conduit control valve in the lower transfer conduit; and
(k) an upper transfer conduit connecting from the purge gas supply conduit at a point downstream of the purge gas control valve to the pressure building conduit at a point downstream of the pressure building control valve, for transferring liquid or gas into the inner container and withdrawing gas from the inner container.

In a preferred embodiment, the trailer has not more than seven penetrations of its inner container for ports and entering conduits, for performing at least the functions of:

(a) conveying liquid from proximate the bottom of the inner container to a heat exchanger;
(b) conveying liquid to and from proximate the bottom of the inner container;
(c) conveying gas from the heat exchanger to proximate the top of the inner container, withdrawing vapor from proximate the top of the inner container, and conveying liquid and vapor to proximate the top of the inner container;
(d) relieving excess pressure proximate the top of the inner container;
(e) sensing pressure proximate the top of the inner container;
(f) withdrawing a liquid sample from proximate the bottom of the container; and
(g) sensing liquid level proximate the top of the inner container.

The trailer with its integral heat exchanger and piping is capable of purging a receiver with ultra-high-purity gas and transferring its liquid contents into the receiver without causing unacceptable contamination of the transferred liquid.

DETAILED DESCRIPTION OF THE INVENTION

Figure 1:
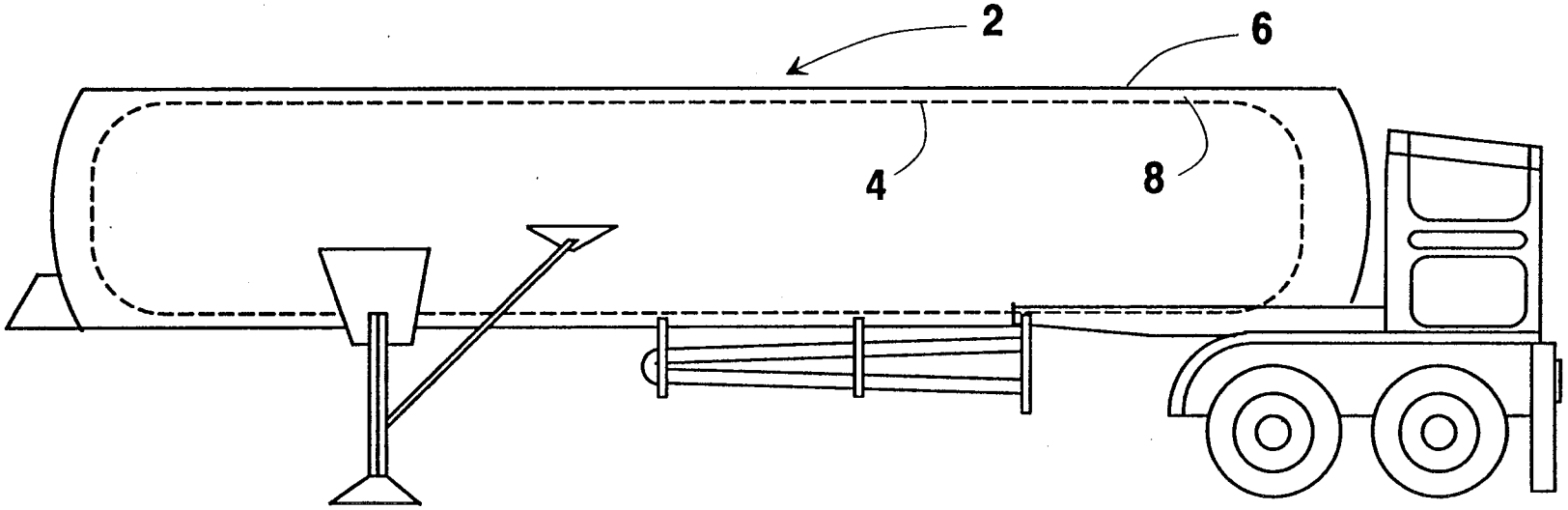
FIG. 1 is a side elevation of a preferred embodiment of the trailer of the present invention.
Figure 2:
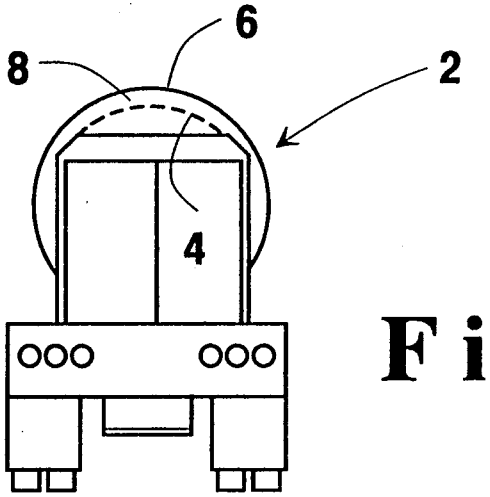
FIG. 2 is an end view of the trailer depicted in FIG. 1.
Figure 3:
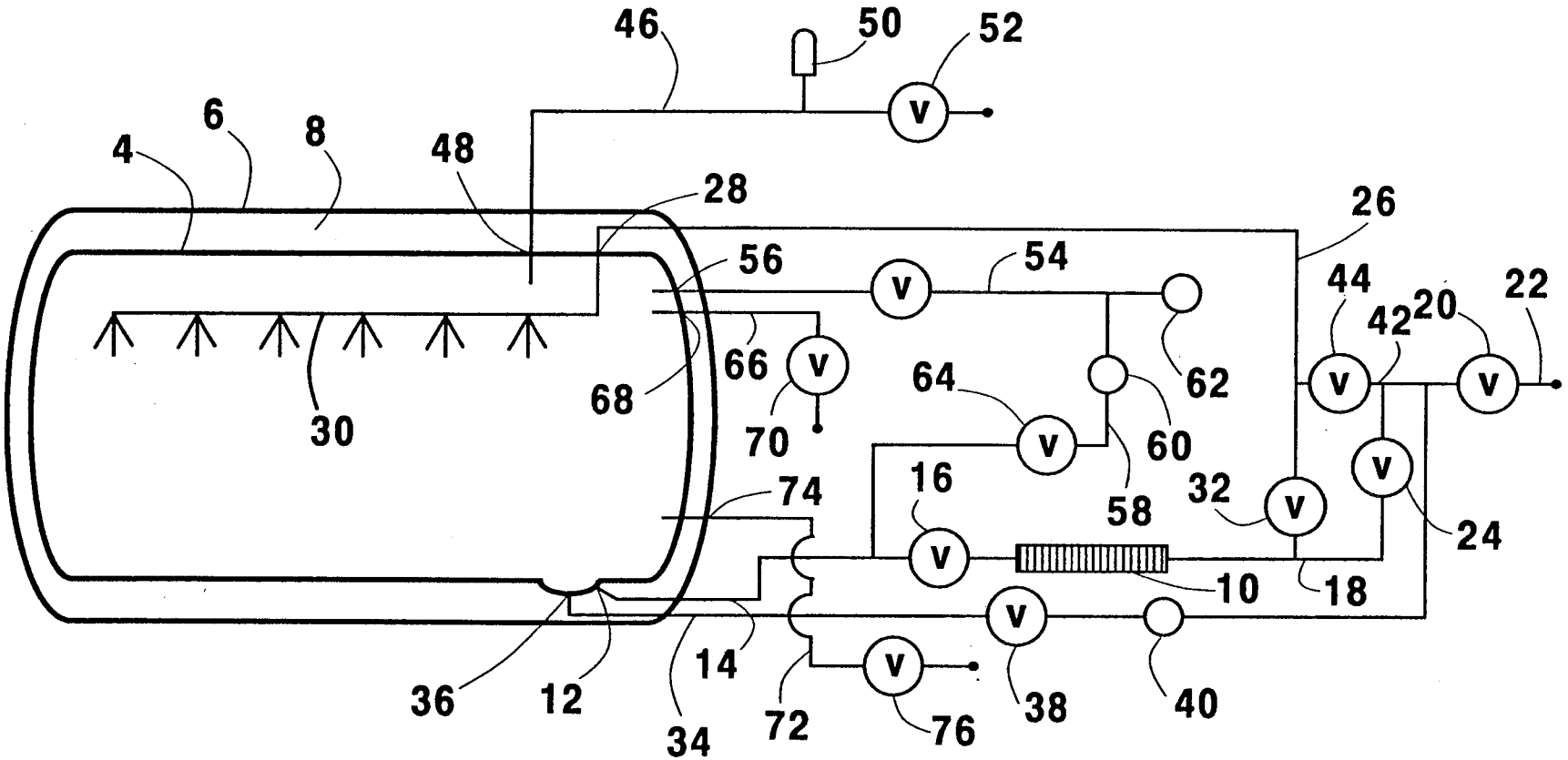
FIG. 3 is a schematic drawing depicting a portion of the inner container of the trailer, its associated piping and associated components.

A preferred embodiment of the present invention is illustrated by way of example in FIGS. 1–3. The trailer 2 has an inner container 4 for liquid and liquid vaporized into vapor or gas. Surrounding the inner container 4 is an outer shell 6 forming a space 8. Around the inner container is high efficiency insulation to minimize the heat leak into the inner container. Multi-layer insulation is preferred comprising multiple wrappings of the inner container with alternate layers of aluminum foil and glass paper. A thickness of 1 inch or 55 to 65 layers of foil and paper is suitable. The space 8 between the inner container 4 and outer shell 6 containing the insulation is evacuated to a pressure of less than 1 micron of mercury to achieve low thermal conductivity.

The trailer includes a heat exchanger 10 for vaporizing or gasifying cryogenic liquid contained in the inner container. Typically the heat exchanger is heated by natural convection from the atmosphere. However, other means can be provided to supply heat to the heat exchanger, such as forced convection of steam or atmospheric air, or electrical heating.

The inner container 4 has a first lower port 12 proximate its bottom requiring a penetration of the inner container 4. From the first lower port 12, a heat exchanger feed conduit 14 runs to the inlet of the heat exchanger 10. In this conduit is a heat exchanger inlet valve 16 for controlling the liquid feed to the heat exchanger.

From the outlet of the heat exchanger 10, a purge gas supply conduit 18 runs to a terminal valve 20 and a terminal 22 for connection to an external receiver or storage tank. The same terminal 20 is used for connection to an external source of cryogenic liquid when filling the inner container. In the purge gas supply conduit 18 is a purge gas control valve 24.

Also from the outlet of the heat exchanger 10, a pressure building conduit 26 runs to a penetration 28 in the inner container 4 proximate its top. The pressure building conduit 28 has a segment 30 which extends along the top of the inner container commonly at a level where it is just immersed in liquid when the inner container is filled to capacity. Within the inner container, this segment 30 line has holes to distribute emerging liquid or vapor along its length. A valve 32 in the pressure building conduit 24 controls the flow of gas into, and the pressure buildup in, the inner container.

The trailer piping includes a lower transfer conduit which runs from a second lower port 36 in the inner container proximate its bottom, in succession, to a control valve 38, a flow meter 40, the terminal valve 20 and the terminal 22. The lower transfer line 34 is used to transfer liquid from the inner container 4 to a tank or receiver connected to terminal 22. The second lower port 36 constitutes another penetration of the inner container 4.

The trailer piping further comprises an upper transfer conduit 42 connecting from the purge gas supply conduit 18 at a point downstream of the purge gas control valve 24 to the pressure building conduit 26 at a point downstream of the pressure building control valve 32. An upper transfer conduit control valve 44 is positioned in this conduit. Opening this valve 44 allows the terminal 22 to communicate with the pressure building conduit 26. Thus liquid or gas can be transferred from an external source connecting with the terminal 22 into the pressure building line 26 and then into the top of the inner container 4. The upper transfer conduit 42 also serves for transferring vapor or gas from the inner container to the terminal 22.

With the conduits described, all the desired functions of transferring liquid and vapor to and from the inner container 4 are accomplished advantageously through the single terminal 22. The piping and components in the ultra-high-Purity trailer allow an external receiver to be purged and filled without opening any connections, as is required in prior art trailers.

For pressure control and safety, an excess pressure relief conduit 46 enters the inner container 4 at an upper port or through an upper penetration 48. It protrudes only to a level below the top of the inner container where it is above the liquid level when the inner container is filled to its intended capacity. Spring-loaded relief valves 50 in this line open to relieve excess pressure by venting gas from the inner container and close without allowing influx of air into the relief line 46 and the inner container 4. Two duplicate sets of primary and secondary pressure relief valves are provided. A switching valve enables one set of valves to be in service while the other set is being serviced. At the end of the pressure relief conduit 46 is a valve 52 which is used for purging the pressure relief conduit 46.

The trailer includes piping for differential pressure sensing to determine the liquid level and contents of the inner container. For this purpose, a tube 54 enters the inner container 4 through a penetration 56 to sense the pressure proximate the top of the inner container. To sense the pressure at the bottom of the inner container, a tube 58 taps into the pressure building conduit 26 at a point upstream of the heat exchanger inlet valve 16. A differential pressure indicator 60 is connected across these two tubes. A pressure gauge 62 is connected to the tube 54 sensing the pressure proximate the top of the inner container. Isolation valves 64 are provided to isolate the differential pressure gage 60.

A liquid level sensing line 66 enters the top of the inner container 4 through a penetration 68 and extends a short distance downward into the container. Opening the trycock 70 on this line and observing the phase of the fluid escaping determines whether the liquid level is above or below the end of the trycock line. The level indicated by this line is the maximum level to which the inner container 4 is filled with liquid. This line also serves to allow withdrawal of a vapor sample. To provide a means for withdrawing a liquid sample, a line 72 makes a penetration 74 the inner container proximate its bottom and terminates in a valve 76.

The lower transfer conduit 34 optionally has a flow meter 40 to measure the rate and quantity of liquid transferred. To avoid the generation of particles, the flow meter has minimal internal movement of functional parts for measurement. An example is a meter which detects the amount of displacement of a U-shaped tube through which the flow passes.

To avoid particle generation which would be produced by a pump, transfer from the inner container in the ultra-high-purity trailer is accomplished by pressurization of the inner container. The inner container is designed to a working pressure in the range of from about 100 psig to about 300 psig, preferably 275 psig which provides for sufficient pressurization to produce an adequate unloading rate.

The inner container and its associated piping are constructed of type 316L stainless steel. The low carbon content of this alloy when welded results in welds of low carbon contamination and good corrosion resistance. This alloy also has good resistance to pitting and crevice corrosion.

Gauges and valves are connected with the piping by mechanical seals using flat metal glands. Operating valves are of a packless design using a metal bellows or a metal diaphragm. Valves are of 316L stainless steel and are electropolished.

Wetted volumes and surfaces in the ultra-high-purity trailer require thorough purging to prevent contamination of new contents by prior contents when different from the new contents. Rough surfaces and porous surfaces typically produced by welding are particularly susceptible to retaining prior contents which can exude over long periods of time. Rough surfaces in themselves generate contamination by spalling off minute particles.

To reduce surface roughness, the inner container and its associated piping in the ultra-high-purity trailer is electropolished to an average surface roughness of less than 20 microinches, except for welded joints. Preformed electropolished elbow and tee fittings are used to avoid fracture of electropolished surfaces by tube bending. Therefore orbital welding and butt joining are used to reduce welding detriments. The heat exchanger has aluminum finned tubes with stainless steel linings which are orbitally welded to inlet and outlet piping.

In particular, welds around penetrations of the inner container for ports and for protruding tubes are susceptible to roughness, porosity and crevice formation. Thus the number and size of penetrations of the inner container are reduced in the ultra-high-purity trailer relative to standard trailers.

In a preferred embodiment of the ultra-high-purity trailer, as depicted in FIG. 1, the inner container has seven penetrations for performing the functions as already described, namely: (a) a first lower port proximate the bottom of the inner container, for conveying liquid from proximate the bottom of the inner container to a heat exchanger; (b) a second lower port proximate the bottom of the inner container, for conveying liquid to and from proximate the bottom of the inner container, to and from a terminal for connection to an external source or receiver; (c) an upper penetration proximate the top of the inner container, for conveying gas from a heat exchanger to proximate the top of the inner container, and, via a terminal, withdrawing vapor from and conveying liquid and vapor to proximate the top of the inner container; (d) an upper penetration or port for relieving excess pressure proximate the top of the inner container; (e) an upper penetration for sensing pressure proximate the top of the inner container; (f) a lower penetration for withdrawing a liquid sample proximate the bottom of the inner container; and (g) an upper penetration for a trycock for liquid level sensing proximate the top of the inner container. The number of penetrations is reduced by one by using a common lower port in the inner container for conveying liquid to the inlet of the heat exchanger and for conveying liquid to and from the terminal.

Eliminating the trycock line for sensing the liquid level at the intended full capacity of the trailer also eliminates a penetration of the inner container. The differential pressure gauge is then used to determine when the full capacity of the trailer has been reached. Alternatively, the full capacity of the trailer is gauged by its weight by placing the trailer on a scale for the filling operation.

The penetration for sensing the pressure proximate the top of the inner container is also eliminated in another embodiment, and this pressure may be sensed by a tap in the excess pressure relief conduit. Further still, the penetration for the liquid sample is eliminated and provisions are made for withdrawing liquid samples from the conduit from the lower port provided in the inner container for supplying liquid to the heat exchanger. Thus all desired functions are accommodated in an embodiment with three penetrations of the inner container.

To fill an empty external receiver from the trailer, the trailer piping terminal is connected to the receiver inlet line. The heat exchanger inlet valve is opened conveying liquid from the inner container to the heat exchanger where the liquid is vaporized into a gas stream. The purge conduit control valve is opened conveying vapor or gas from the heat exchanger into the receiver where it purges the receiver of prior contents.

Vapor or gas from the heat exchanger is also conveyed to the top of the inner container by opening the pressure building control valve thereby causing the pressure of the inner container to rise. The pressure in the inner container typically is increased to a value in the range of from about 100 psig to the design maximum working pressure of the inner container. While a design maximum working pressure of 300 psig or higher is feasible, a design maximum working pressure of 275 psig is preferred. Building the pressure within the inner container to this value provides sufficient pressure difference for the transfer of liquid from the inner container to an external receiver at a reasonable rate of flow. After the desired inner container pressure has been achieved, the pressure building control valve may be closed.

After the receiver has been adequately purged, the purge gas control valve is closed. The lower transfer conduit control valve is opened thereby conveying liquid from the trailer inner container into the receiver. No disconnecting and reconnecting of the receiver from the trailer piping occurs, thus avoiding any open connections through which air can enter. The differential pressure between the inner container and the external receiver preferably provides the motive force for the transfer flow. Alternatively, a pump can be used but will have the undesired effect of introducing some contaminants through seal leakage, off-gassing and particulate shedding.

Although the invention has been described with reference to specific embodiments, it will be appreciated that it is intended to cover all modifications and equivalents within the scope of the appended claims.

What is claimed is:

1. A trailer for transporting cryogenic liquid, purging a receiver and transferring the liquid into the receiver, said trailer having:

(a) an inner container for liquid and gas;

(b) a heat exchanger for gasifying cryogenic liquid;

(c) a heat exchanger feed conduit communicating the inlet of said heat exchanger with a first lower port proximate the bottom in said inner container;

(d) a terminal for connection to an external source of cryogenic liquid or to a receiver;

(e) a purge gas supply conduit connecting the outlet of said heat exchanger with said terminal, said purge gas supply conduit for supplying gas through said terminal to purge a receiver connected to said terminal;

(f) a purge gas control valve in said purge gas supply conduit;

(g) a pressure building conduit connecting the outlet of said heat exchanger with an upper port proximate the top in said inner container, said pressure building conduit for supplying gas from said heat exchanger to said inner container to build pressure in said inner container;

(h) a valve in said pressure building conduit for controlling the flow of gas into, and the pressure buildup, in said inner container;

(i) a lower transfer conduit communicating said terminal with a second lower port proximate the bottom in said inner container, for transferring liquid to and from said inner container via said terminal;

(j) a lower transfer conduit control valve in said lower transfer conduit;

(k) an upper transfer conduit connecting from said purge gas supply conduit at a point downstream of said purge gas control valve to said pressure building conduit at a point downstream of said pressure building control valve, for transferring liquid or gas into said inner container and withdrawing gas from said inner container; and (l) an upper transfer conduit control valve in said upper transfer conduit.

2. The trailer as in claim 1 wherein said pressure building line is for supplying gas from the heat exchanger to build the pressure in the inner container to more than 30 psig.

3. The trailer as in claim 1 wherein said pressure building conduit is for supplying gas from said heat exchanger to build the pressure in said inner container to a pressure in the range of from about 100 psig to about 300 psig.

4. The trailer as in claim 1 wherein said inner container is constructed to have a working pressure in the range of from about 100 psig to about 300 psig.

5. The trailer as in claim 1 wherein said heat exchanger is capable of warming the gas to at least 32° F.

6. The trailer as in claim 1 wherein substantially all surfaces wetted by the liquid and vapor contents of the trailer are comprised of 316L stainless steel.

7. The trailer as in claim 1 wherein substantially all surfaces wetted by the liquid and vapor contents of the trailer, except welded surfaces, are electropolished to an average roughness of not more than 20 microinches.

8. The trailer as in claim 1 further comprising a heat exchanger inlet valve in said heat exchanger feed conduit.

9. The trailer as in claim 1 wherein said pressure building conduit enters said upper port and communicates with a distributing conduit within said inner container.

10. The trailer as in claim 9 wherein said first lower port for said heat exchanger inlet and said second lower port for said lower transfer line are the same port.

11. The trailer as in claim 9 wherein said trailer has not more than one terminal for communicating said inner container with an external source or receiver.

12. A trailer for transporting cryogenic liquid, purging a receiver, and transferring the cryogenic liquid into the receiver, said trailer having an inner container with not more than seven penetrations comprising:

a) means for conveying liquid from proximate the bottom of said inner container to a heat exchanger;

(b) means for conveying liquid to and from proximate the bottom of said inner container;

(c) means for conveying gas from the heat exchanger to proximate the top of said inner container, withdrawing vapor from proximate the top of said inner container, and conveying liquid and vapor to proximate the top of said inner container;

(d) means for relieving excess pressure proximate the top of said inner container;

(e) means for sensing pressure proximate the top of said inner container;

(f) means for withdrawing a liquid sample from proximate the bottom of said container; and (g) means for sensing liquid level proximate the top of said inner container.

13. The trailer as in claim 12 wherein said inner container has not more than six penetrations.

14. The trailer as in claim 12 wherein said inner container has not more than five penetrations.

15. The trailer as in claim 12 wherein said inner container has not more than four penetrations.

16. The trailer as in claim 12 wherein said inner container has not more than three penetrations.

17. A method of purging and transferring cryogenic liquid into a storage tank from a cryogenic liquid trailer having an inner container, said method comprising:

(a) conveying a liquid stream from the trailer inner container into a heat exchanger;

(b) gasifying the liquid stream into a gas stream in the heat exchanger;

(c) conveying the gas stream into the storage tank and purging the tank;

(d) conveying at least part of the stream of gas from the heat exchanger into the trailer inner container to build pressure in the trailer inner container; and (e) conveying liquid from the trailer inner container into the storage tank.

18. The method as in claim 17 further comprising the step of controlling the flow of gas into the inner container to build a pressure in the inner container in excess of 30 psig.

19. The method as in claim 17 further comprising the step of controlling the flow of gas into the inner container to build a pressure in the inner container in the range of from about 100 psig to about 300 psig.

20. The method of claim 17 wherein said conveying of liquid from the trailer inner container into the storage tank is by pressurization of said inner container by the gas from the heat exchanger.

21. The method as in claim 17 wherein the gas stream is warmed in the heat exchanger to a temperature of at least 32° F.

22. The method as in claim 17 wherein the step (c) of conveying of the gas stream into the storage tank and purging the tank is followed by the step (e) of conveying liquid from the trailer inner container into the storage tank without disconnecting the storage tank from, and reconnecting the storage tank to, the trailer.

* * * * *